US006119568A

United States Patent [19]

Yamauchi

[11] Patent Number: 6,119,568

[45] Date of Patent: Sep. 19, 2000

[54] PIERCING APPARATUS

[75] Inventor: Takumi Yamauchi, Nukata-gun, Japan

[73] Assignee: DENSO Corporation, Kariya, Japan

[21] Appl. No.: 09/287,042

[22] Filed: Apr. 6, 1999

[30] Foreign Application Priority Data

Apr. 7, 1998 [JP] Japan ..... 10-094588
Jan. 11, 1999 [JP] Japan ..... 11-004123

[51] Int. Cl.[7] ..... B23D 5/00

[52] U.S. Cl. ..... 83/332; 83/675

[58] Field of Search ..... 83/332, 102, 105, 83/113, 161, 167, 168, 649, 675

[56] References Cited

U.S. PATENT DOCUMENTS 845,764 3/1907 Curtis ..... 83/303
1,301,332 4/1919 Spiegel ..... 83/167

FOREIGN PATENT DOCUMENTS 710630 6/1965 Canada ..... 83/332
8-10869 1/1996 Japan .

*Primary Examiner*—M. Rachuba
*Assistant Examiner*—Dominic Troiano
*Attorney, Agent, or Firm*—Pillsbury Madison & Sutro LLP

[57] ABSTRACT

In order to achieve speed up of the piercing operation to form elongated forms in a thin sheet whose length is greater than the thickness and width thereof, a piercing apparatus is provided with an upper roller die having a first cutter roller held between press rollers so that the first cutter roller protrudes at the outer peripheral portion thereof, from the outer peripheral surfaces of the press rollers, a lower roller die having recesses between two second cutter rollers and engaging with the outer peripheral portion of the first cutter roller. The thin sheet is continuously fed in the lengthwise direction thereof into the engagement portion between the upper and lower dies. When a sliding cutter is engaged in the recesses formed on the first cutter roller, the thin sheet passing through the engagement portion is cut to form elongated holes.

26 Claims, 8 Drawing Sheets

PIERCING APPARATUS

BACKGROUND OF THE INVENTION

1. Field of the Invention

The present invention relates to a piercing apparatus for making a hole in a workpiece by engagement of a pair of rotary rollers.

2. Description of the Related Art

In conventional pressing machines, as piercing apparatuses, to make holes in a workpiece, for example, the workpiece in the form of an elongated thin sheet whose length is much greater than the thickness thereof is moved in the lengthwise direction thereof and is introduced in a press die to form elongated holes elongated in the lengthwise direction or the width direction thereof.

In known press machines, upon pressing, such as precision shearing, it is necessary to temporarily stop the feed of the thin sheet and move the upper and lower dies close to each other to pierce the thin sheet, while holding the periphery of the thin sheet. To this end, the feed speed and the stopping position of the thin sheet must be accurately controlled. However, the higher the piercing speed, the lower the accuracy, and hence it is difficult to increase the speed of the piercing of the thin sheet.

Moreover, to increase the piercing speed for the thin sheet, it is necessary to provide a chip discharge apparatus which can immediately and effectively discharge chips cut away from the thin sheet. However, the chips which are produced when elongated holes whose length in the lengthwise direction of the thin sheet is much longer than the thickness of the thin sheet are formed can twine around each other or the discharge passageway may be blocked with the chips. If this occurs, the press machine must be stopped at each occurrence to remove the entwined chips, thus making it difficult to increase the piercing speed of the thin sheet.

In recent years, there has been a need to carry out the press process of a workpiece and the mounting process of the workpiece thus machined in the same process line. To this end, it has been proposed to incorporate the press process in the mounting process. However, since the pressing speed, of the workpiece, by the press machine is low in comparison with the mounting speed which has been increased in an automated production line, it is necessary to reduce the mounting speed so as to meet the lower press speed. Under these circumstances, it required to provide a press machine having a high press speed corresponding to the mounting speed.

SUMMARY OF THE INVENTION

It is an object of the present invention to provide a piercing apparatus in which the speed of the piercing operation of a workpiece can be increased.

Another object of the present invention is to provide a piercing apparatus in which the piercing speed can be increased corresponding to the speed-up of the automated mounting operation.

Yet another object of the present invention is to provide a piercing apparatus in which chips cut away from the workpiece can be quickly discharged.

According to the invention of claim 1, the workpiece is continuously fed to the engagement portion between the first cutter of the first rotation roller and the second cutter of the second rotation roller and thus can be cut to form holes therein. When the cut chip discharge means provided on the second rotation roller is engaged in the recesses provided on the outer periphery of the first cutter of the first rotation roller, the cut chips are separated from the workpiece. Therefore, it is possible to form holes in the workpiece by the engagement of the first and second rotating cutters without stopping the movement of the workpiece, thus resulting in speed up of the piercing operation for the workpiece. Moreover, it is possible to carry out the piercing operation at a working speed corresponding to the speed of the automatic mounting operation.

According to an invention claimed in claim 2, since the first cutter is provided on the outer periphery thereof with a plurality of recesses at a predetermined distance, and the second rotation roller is provided with a plurality of cut chip discharge means corresponding to the recesses at the same pitch as that of the recesses, if the radial dimensions of the first and second rotation rollers are substantially identical and if the circumferential dimensions of the first and second cutters are substantially identical, not only can a number of holes at a predetermined pitch be formed in the workpiece, but also a predetermined length of cut chips can be separated from the workpiece.

According to an invention claimed in claim 3 or 4, the thin sheet whose length is very large in comparison with the thickness or width thereof is continuously fed in the lengthwise direction thereof into an engagement portion between the first and second rotating cutters. Consequently, elongated holes which are elongated in the lengthwise direction of the thin sheet and whose length is much larger than the thickness of the thin sheet can be formed, as in the invention claimed in claim 1.

According to an invention claimed in any one of claims 5 to 8, if the cut chips are separated from the workpiece by the chip discharge means, the cut chips are held in the recesses provided in the second rotation roller and are rotated together therewith. The cut chips rotating together with the second rotation roller are scraped from the second cutter by the scraper as small spiral cut chips. The spiral cut chips can be smoothly discharged without being entangled or obstructing the discharge passage. Consequently, it is not necessary to stop the piercing apparatus to remove the entangled cut chips or the obstructing cut chips, and hence the cut chips separated from the workpiece can be immediately and efficiently discharged. Thus the speed of the piercing operation can be increased.

According to an invention claimed in any one of claims 9 to 12, when the cut chips, which have been separated from the workpiece by the chip discharge means and which are held in the recesses of the second cutter and are rotated together with the second rotation roller, are brought into contact at the one end thereof with the arc-shaped chip forming portion of the scraper the cut chips are successively coiled from the end thereof in accordance with the rotation of the second rotation roller. Consequently, small spiral cut chips are obtained. Thus, the same effects as those in the claim 4 can be obtained.

According to an invention claimed in any one of claims 13 to 20, since the sliding cutter is retractably projected from the recesses of the second rotation roller by the cam incorporated in the second rotation roller so as to prevent an interference between the sliding cutter and the scraper, there is no fear that the second rotation roller cannot be rotated due to the contact between the sliding cutter and the scraper.

According to an invention claimed in claim 21, since there are predetermined gaps (cutting edge interference prevention gaps) provided between the front and rear ends of the chip discharge means engaged in the recesses in the direction of the movement of the second rotation roller and the front and rear ends of the first cutter in the direction of the movement of the first rotation roller when the chip discharge means are engaged in the recesses, there is no fear that the first and second rotation rollers cannot be rotated due to the interference of the portion of the chip discharge means that is engaged in the recess, with the recess.

According to an invention claimed in claim 22, since the front and rear ends of the cut chip discharge means that is engaged in the recess in the direction of the movement of the second rotation roller are shaped to prevent cutting edge interference, the first rotation roller and the second rotation roller can rotate while the chip discharge means is engaged in the recess. Thus, it is possible to prevent the first and second rotation rollers from being unable to rotate due to the interference between the portion of the chip discharge means that is engaged in the recess with the recess.

DESCRIPTION OF THE PREFERRED EMBODIMENTS

<Structure of Embodiments>

Figure 1:
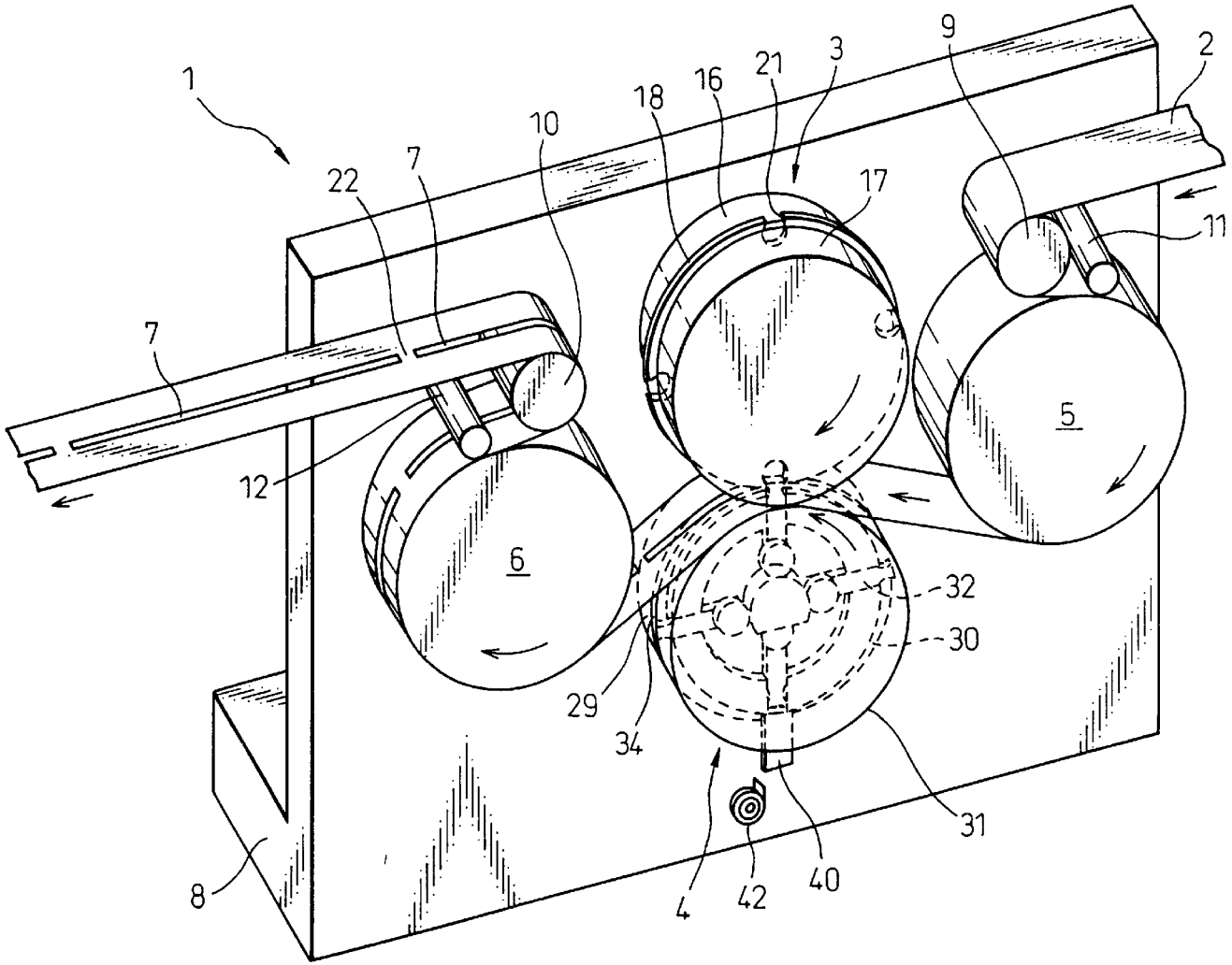
FIG. 1 is a perspective view of the whole structure of an elongated hole-piercing apparatus.

Embodiments of the present invention will be discussed below with reference to the accompanying drawings. FIG. 1 shows the whole structure of an elongate hole-piercing apparatus.

The elongated hole-piercing apparatus 1 according to the present invention is in the form of a press apparatus in which a thin sheet or plate 2 (workpiece to be machined) whose length is very long relative to the thickness (e.g., approximately 0.1 mm) and width (e.g., approximately 37.0 mm) is continuously fed in the lengthwise direction thereof toward an engaging portion of a pair of upper and lower roller dies 3 and 4, by means of a workpiece feed mechanism such as feed rollers 5 and 6, to form elongated holes 7 which are elongated in the lengthwise direction to have a length much greater than the thickness of the workpiece (For example, the length of one elongated hole is 111.5 mm long and 0.5 mm width). In the illustrated embodiment, the sheet 2 is a metal plate material, such as an aluminum alloy, which can be used as blanks for corrgate fins which are incorporated in a condenser or evaporator for an radiator for cooling an engine and in a heater core for a heater or air conditioner.

The feed rollers 5 and 6 are provided on the front and rear sides of the upper and lower dies 3 and 4. The drive shafts (not shown) of the feed rollers 5 and 6 are rotatably mounted to a stand 8 which is secured to a predetermined stationary member (not shown). A tension roller 9 is provided on the portion of the stand 8 on the preceding machining station of the feed roller 5 to provide a predetermined tensile force to the thin sheet so as to move in a predetermined direction. Likewise, a tension roller 10 is provided on the portion of the stand 8 on the subsequent machining station of the feed roller 6. The feed rollers 5 and 6 are provided with winding rollers 11 and 12 which are adopted to effectively wind the thin sheet 2 around the feed rollers 5 and 6 without a separation of the thin sheet 2.

Figure 2:
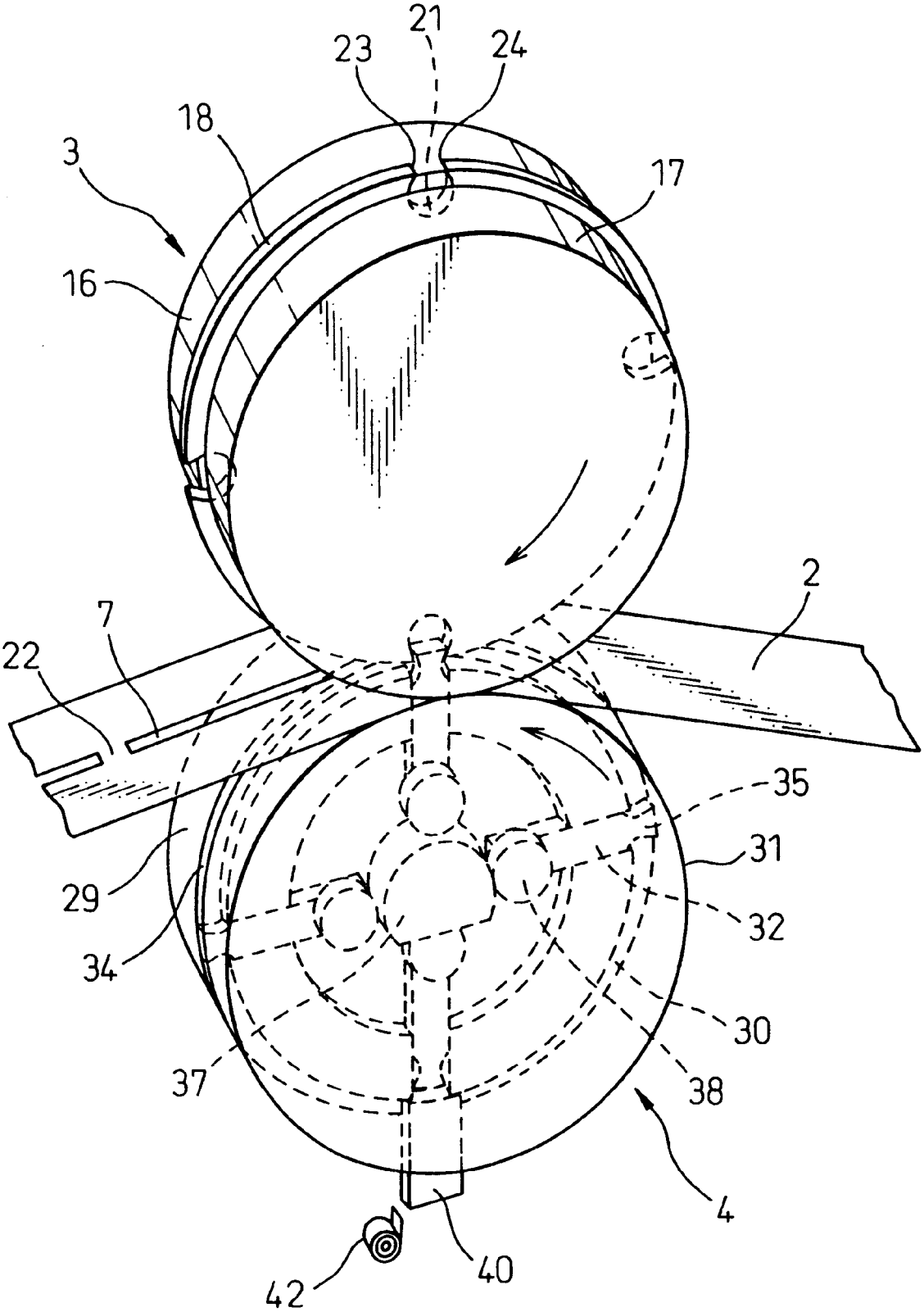
FIG. 2 is a perspective view of upper and lower dies in the form of a pair of rollers.
Figure 3:
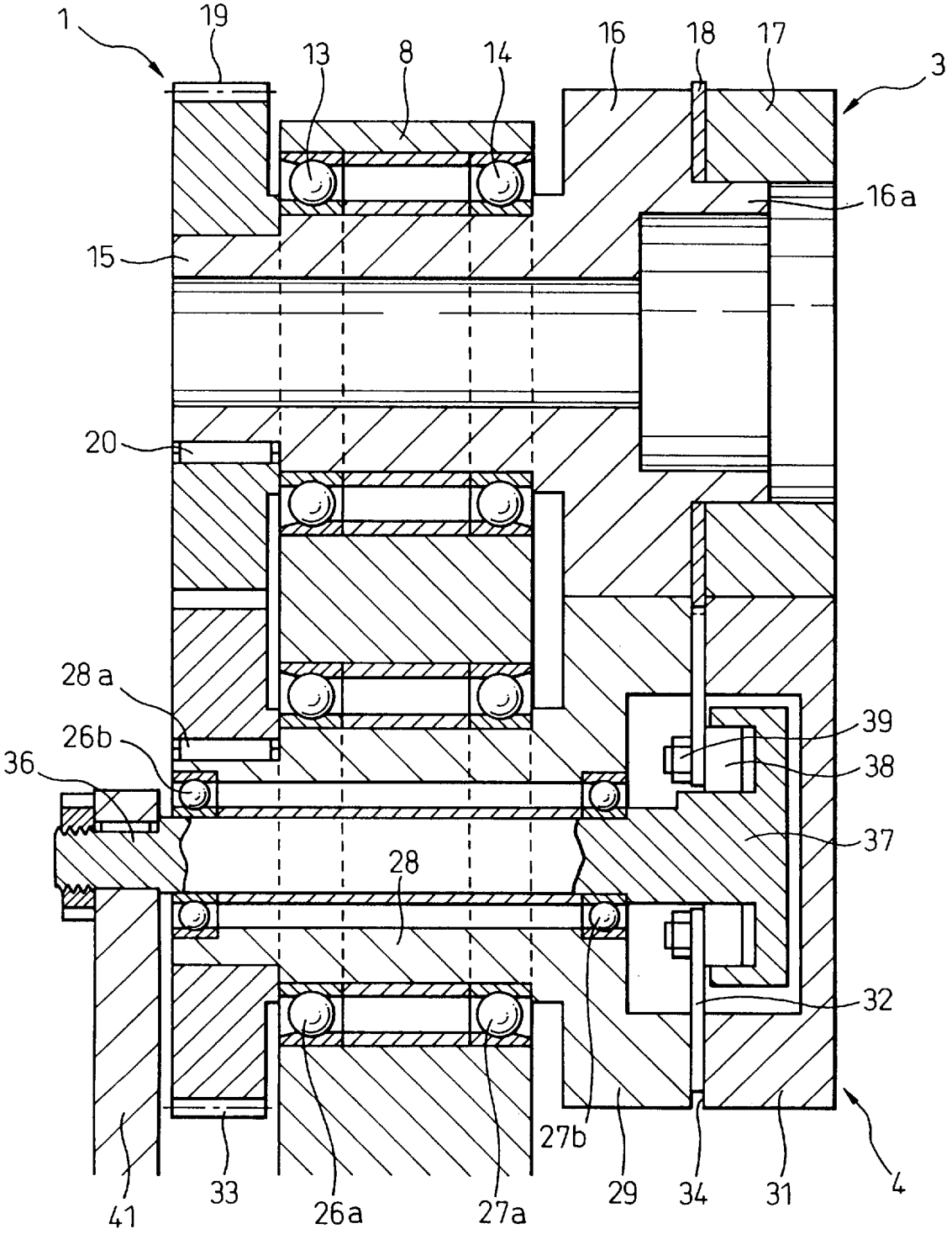
FIG. 3 is a sectional view of main components of an elongated hole-piercing apparatus.
Figure 4:
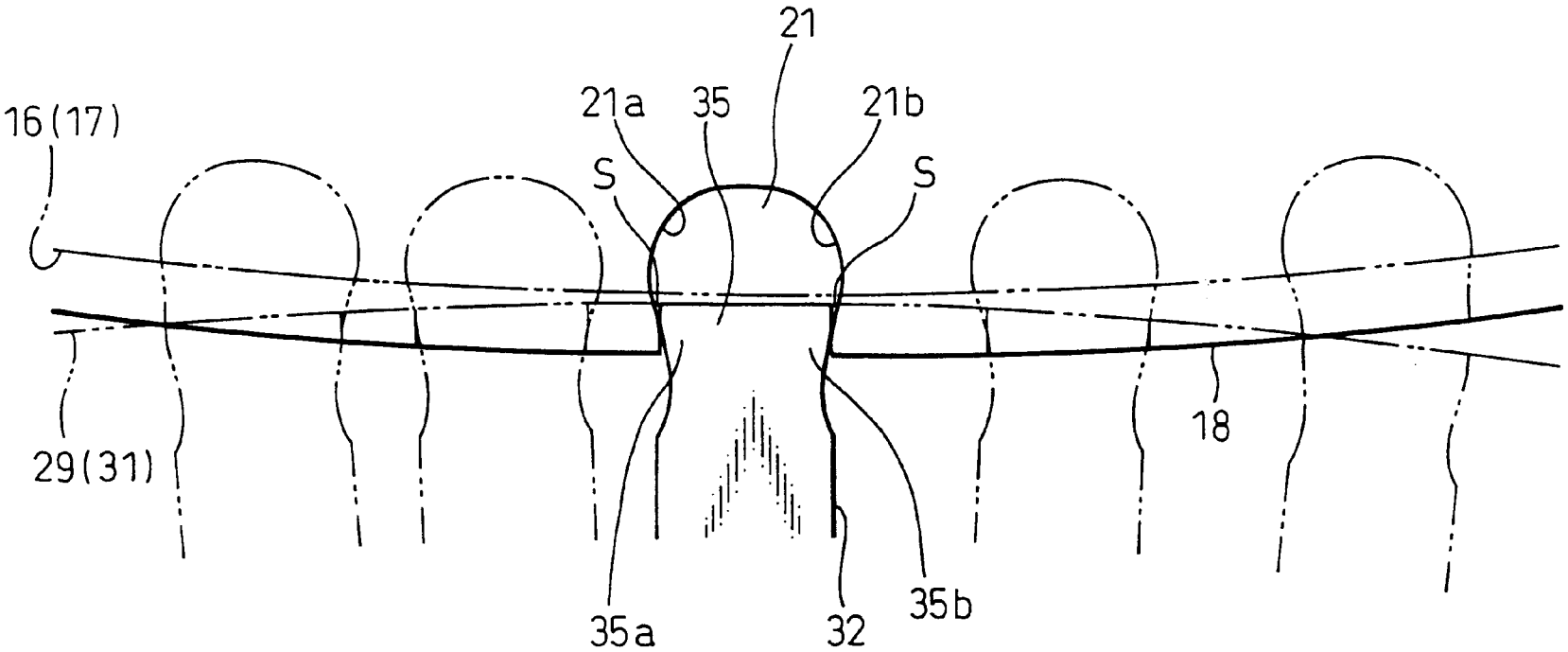
FIG. 4 is a front elevational view of upper and lower dies to show shapes of main parts thereof.
Figure 5:
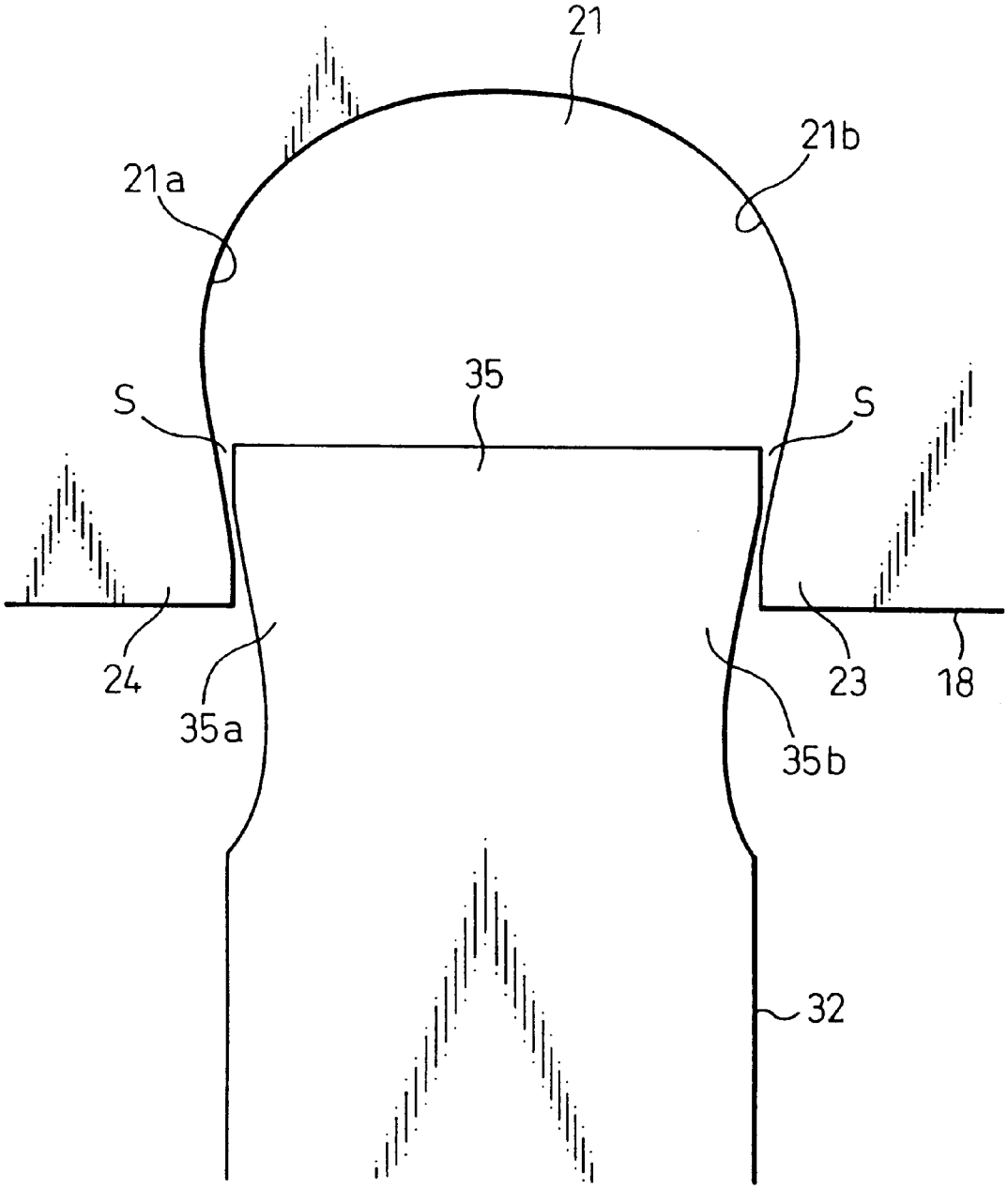
FIG. 5 is an enlarged view of upper and lower dies to show shapes of main parts thereof.
Figure 6:
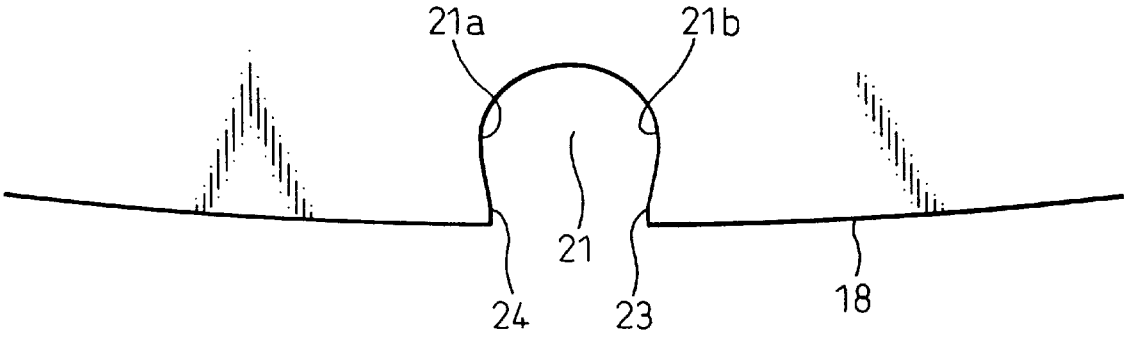
FIG. 6 is a front elevational view of an upper die to show a shape of a main part thereof.

The upper and lower dies 3 and 4 in the form of a pair of rollers will be explained below, referring to FIGS. 1 through 6. FIG. 2 shows a pair of upper and lower dies 3 and 4; FIG. 3 shows a main part of an elongated hole-piercing apparatus 1; FIGS. 4 and 5 show a main part of the upper and lower dies 3 and 4; and, FIG. 6 shows a main part of the upper die 3.

The upper die 3 in the form of a roller corresponds to a first rotation roller specified in the present invention. The upper die 3 is comprised of a circular-annular press roller 16 which is integrally formed with the front end (right end in FIG. 3) of a cylindrical drive shaft 15 which is rotatably supported on an inner surface of an opening formed in the stand 8, by bearings 13 and 14, a circular-annular press roller 17 which is provided on an outer peripheral surface of a cylindrical portion 16*a* attached to the front end of the press roller 16, a cutter roller 18 held between the press rollers 16 and 17, and a fastening device such as a bolt to fasten and secure the rollers 16, 17 and 18 integrally.

A circular-annular drive gear 19 is mounted to the outer peripheral surface of the rear end (left end in FIG. 3) of the drive shaft 15. There is a pin 20 between the drive shaft 15 and the drive gear 19 to prevent a relative rotation therebetween.

The cutter roller 18 corresponds to a first convex cutter specified in the present invention. The cuter roller 18 is held between the press rollers 16 and 17 and the outer peripheral portion of the cutter roller 18 protrudes outward from the outer peripheral surfaces of the press rollers 16 and 17, at the cutting portion (the portion to cut the thin sheet 2). The cutting portion of the cutter roller 18 defines the ends and sides of the elongated holes 7 to be pierced in the thin sheet 2. The cutter roller 18 is provided on its outer peripheral portion with a plurality of (4 in the illustrated embodiment) recesses 21 which are spaced at an equidi-stance (90 degrees in the illustrated embodiment).

The recesses 21 are each in the form of a slit generally of a Ω-shape in which the open end thereof is narrower than the inner portion, as can be seen in FIGS. 4 and 6 and are adapted to form connecting portions (uncut portions) 22 on the thin sheet 2 and to separate planer cut chips (in practice, an arced plate shape extending along the round shape of the lower die 4) from the thin sheet 2 using two sharp edges 23 and 24 at the opening end. The sharp edge 23 is located on the downstream side of the recess 21 in the direction of the movement of the upper die 3, and the sharp edge 24 is located on the upstream side thereof. Note that the uncut portions 22 define rectangular portions between the two adjacent elongated holes 7 formed in the thin sheet 2 by cutting.

The lower die 4 in the form of a roller corresponds to a second rotation roller defined in the present invention. The lower die 4 is comprised of a circular-annular cutter roller 29 which is integrally formed with the front end (right end in FIG. 3) of a cylindrical drive shaft 28 which is rotatably supported on an inner surface of an opening formed in the stand 8, and on the outer peripheral surface of the cam shaft 36 which will be discussed hereinafter, by bearings 26*a*, 26*b*, 27*a* and 27*b*, a circular-annular cutter roller 31 which is opposed to the front end of the cutter roller 29 so as to hold a circular intermediate member 30 between the cutter roller 31 and the front end of the cutter roller 29, a plurality of (4 in the illustrated embodiment) sliding cutters 32 which are held between the cutter rollers 29 and 31, and a fastening device such as a bolt to fasten and secure the cutter rollers 29,31 and the intermediate member 30 integrally.

The drive shaft 28 is provided on the outer peripheral surface of the rear end thereof (left end in FIG. 3) with a circular-annular drive gear 33 attached thereto. Note that there is a pin 28*a* between the drive shaft 28 and the drive gear 33 to prevent a relative rotation therebetween. One of the drive gear 33 and the driven gear 19 which is in mesh with the drive gear 33 is engaged by a drive gear (not shown) attached to the output shaft of the drive source, such as an electric motor or an internal combustion engine, so that the rotational force of the drive source can be transmitted and that the rotational force is also transmitted to the other drive gear. Thus, the drive gear 19 and the upper die 3 are rotated in a direction opposite to that of the drive gear 33 and the lower die 4.

The cutter rollers 29, 31 correspond to the second concave cutter defined in the present invention and are adapted to form the sides of the elongated holes 7 to be formed in the thin sheet 2. The cutter rollers 29, 31 and the plural intermediate members 30 form a plurality of (4 in this embodiment) recesses 34 on the outer peripheral surface of the lower roller die 4. The recesses 34 have a groove width large enough to hold the planar cut chips 25 (see FIG. 8 or 9) separated from the thin sheet 2. Note that the outer peripheral surfaces of the plural intermediate members 30 define the bottom surfaces of the recessed 34.

Figure 7:
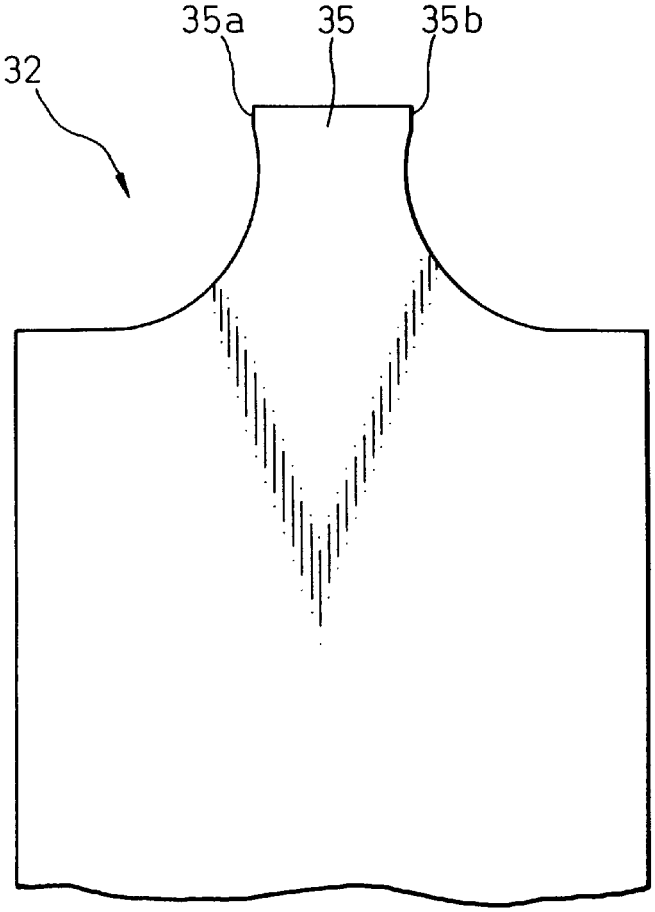
FIG. 7 is a front elevational view of a sliding cutter to show a main part thereof.

The plural sliding cutters 32 correspond to a cut chip removal means defined in the present invention and are slidably provided between the opposed surfaces of the cutter rollers 29, 31 and between the end surfaces of the two adjacent intermediate member 30. The sliding cutters 32 are each provided on its outer side of the front end in the radial direction with a generally inverted triangular-shape of fitting portion 35 which is in turn provided with a recessed portion which can be engaged with corresponding recessed portions 21 formed in the upper die 3, as can be seen in FIG. 7. Consequently, the fitting portions 35 are shaped such that the width thereof increases toward the front end.

The front end portions 35*a* and the rear end portions 35*b* of the engaging portions 35 of the sliding cutter 32 in the direction of the movement of the lower die 4 are shaped so that there is no interference of the cutting edges so as to rotate the upper roller die 3 and the lower roller die 4 while the engaging portion 35 are engaged in the recesses 21 of the cutter roller 18. There are predetermined gaps (cutting edge interference prevention gaps) S between the front ends 21*a* and the rear ends 21*b* of the recesses 21 in the direction of the movement of the upper die 3.

A plurality of sliding cutters 32 are driven to be retracted into or protrude from the recesses 34 by means of a predetermined profile of a cam 37 integrally formed with the front end (right end in FIG. 3) of the cam shaft 36. The plural sliding cutters 32 are provided on the base ends (radially inner ends) thereof with cam followers 38 in the form of circular discs which are in sliding contact with the cam surface of the cam 37 and which are secured thereto by fasteners 39 such as nuts. Note that the cam 37 has a generally semi-circular cross section so as to prevent an interference between the sliding cutters 32 and a scraper 40 which will be discussed hereinafter. The cam shaft 36 is equipped on its rear end (left end in FIG. 3) with a detent 41 attached thereto, which is secured to a predetermined stationary member (not shown).

As shown in FIGS. 1, 2 and 9, the scraper 40 constitutes a cut chip discharging device for an elongated hole-piercing apparatus, together with the recesses 34 provided between the cutter rollers 29 and 31 and a chip discharge passage (not shown) through which spiral cut chips 42 scraped by the scraper 40 can be discharged. The scraper 40 is secured to a stationary member not shown so that the upper end thereof is fitted in the recess 34 and the upper end surface is opposed to the bottom surface of the recess 34. The scraper 40 is located in a position diametrically opposed to the engagement position in which the lower roller die 4 and the upper roller die 3 engage.

The scraper 40 is adapted to scrape and discharge the planar chips 25, temporarily held in the recesses 34, into the chip discharge passage. The scraper 40 is provided with a chip forming portion 43 (FIG. 9) which is brought into contact with one end of the planar cut chips 25 to form spiral cut chips 42. The chip forming portion 43 is provided with an arc abutment surface which is in contact with one end surface of the planar cut chips 25 to guide them spirally.

<Elongated Hole Piercing Process in Embodiment>

The following discussion will be addressed to an elongated hole piercing process for the thin sheet 2 using an elongated hole-piercing apparatus according to the illustrated embodiment, with reference to FIGS. 1 through 9. FIGS. 8*a* through 8*d* show elongated hole piercing steps and FIGS. 9*a* through 9*d* show cut chip discharge steps.

The thin sheet 2 supplied from the preceding station is subject to a predetermined tensile force by the tension roller 9 and is moved to the engagement portion between the upper and lower roller dies 3 and 4 by the feed roller 5.

Figure 8A:
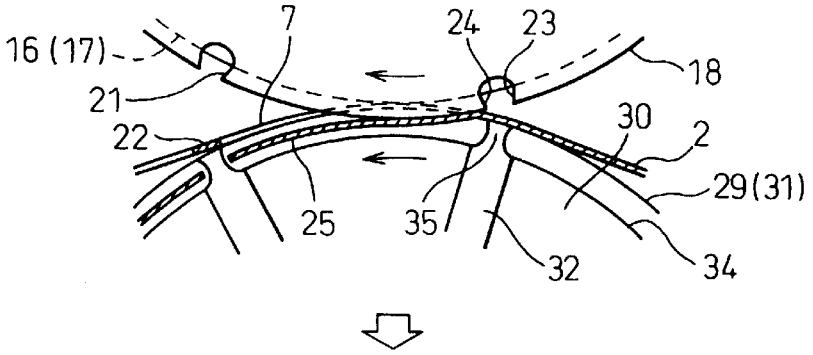
FIGS. 8*a* through 8*d* are explanatory views of a piercing operation to form an elongated hole.
Figure 8B:
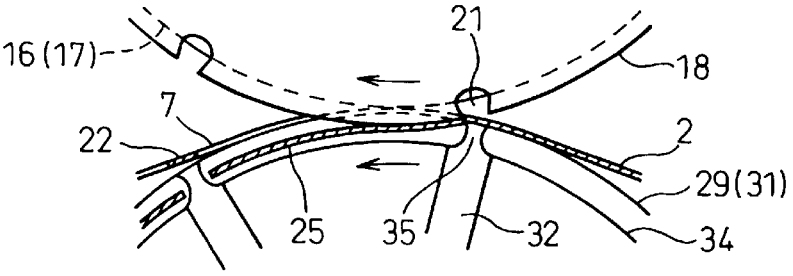
Figure 8C:
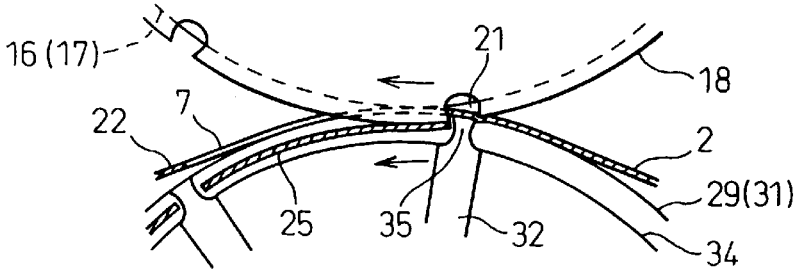
Figure 8D:
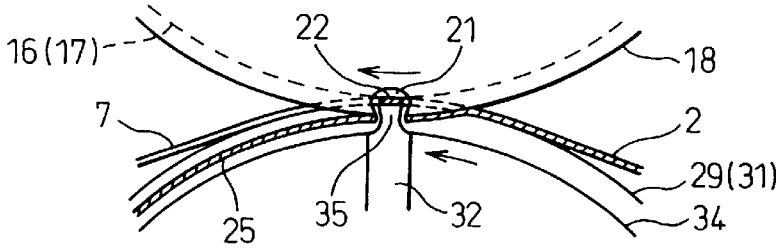

As shown in FIG. 8*d*, the thin sheet 2 is cut to form an end of an elongated hole 7 by the sharp edges 23, 24 of the recess 21, the fitting portion 35 of the sliding cutter 32, and the cutter rollers 29, 31, in a position in which the sliding cutter 32 engages with the recess 21 of the cutter roller 18.

As can be seen in FIG. 8*a*, the thin sheet 2 is cut to form sides of the elongated hole 7 by the cutter roller 18 and the cutter rollers 29, 31 in accordance with the rotation of the upper die 3 and the lower die 4. Note that the planar cut chip 25 which is forced into the recess 34 by the outer peripheral surface of the cutter roller 18 upon forming the sides of the elongated hole 7 is dropped and held in the recess 34, so that the cut chip 25 rotates together with the lower die 4.

Looking at FIG. 8*b*, when the rotation of the upper and lower roller dies 3 and 4 takes place, the portion of the thin sheet 2 that is held between the sharp edge 24 of the recess 21 and the fitting portion 35 of the sliding cutter 32 is separated as a planar cut chip 25 from the remaining portion of the thin sheet 2 because the end of the elongated hole 7 is cut.

When the recess 21 of the cutter roller 18 begins engaging with the sliding cutter 32 in accordance with the rotation of the upper and lower dies 3 and 4, as shown in FIG. 8*c*, the thin sheet 2 is released from the engagement with the cutter rollers 29, 31 and hence the uncut portion 22 is formed on the thin sheet 2. The planar cut chip 25 separated from the thin sheet 2 is still held with in the recess 34 and consequently is rotated together with the lower roller die 4.

As shown in FIG. 8*c*, when the sliding cutter 32 engages in the recess 21 of the cutter roller 18 in accordance with the rotation of the upper and lower dies 3 and 4, the thin sheet 2 is cut to form an end of a subsequent elongated hole 7. The above mentioned elongated hole piercing steps are continuously repeated while feeding the thin sheet 2 continuously into the engagement portion between the upper and lower roller dies 3 and 4 from the preceding station. The feed speed of the thin sheet 2 can be optionally determined, depending on the speed in the preceding or subsequent station.

Figure 9A:
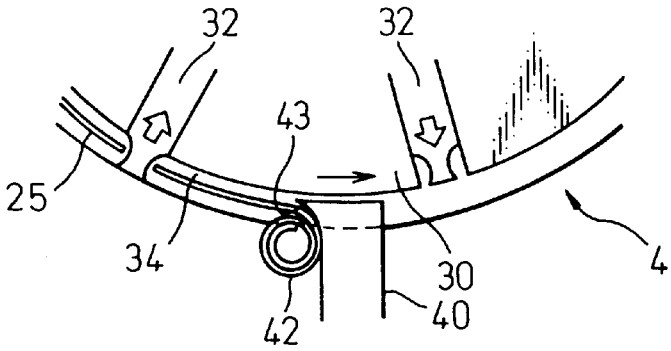
FIGS. 9*a* through 9*d* are explanatory views of a chip discharging operation.
Figure 9B:
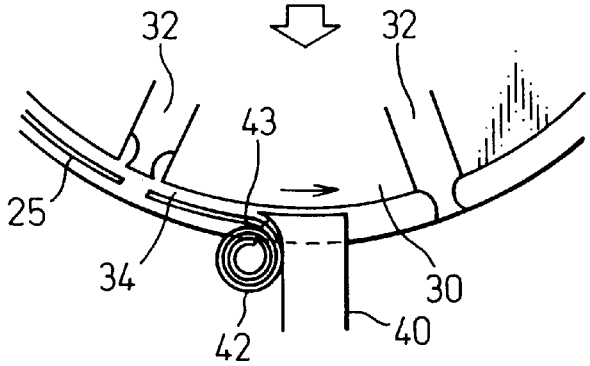
Figure 9C:
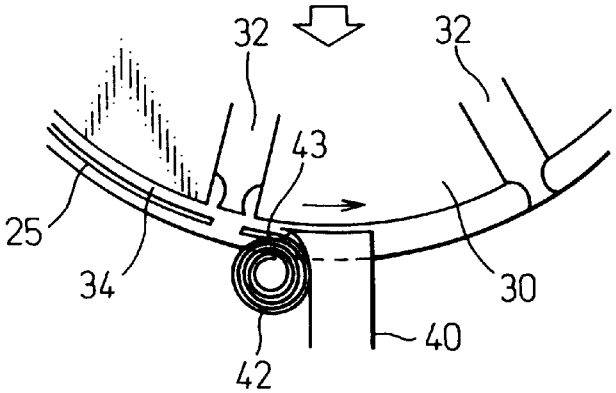

The planar cut chip 25 which is temporarily held in the recess 34 is moved from the engagement portion between the upper and lower roller dies 3 and 4 through an angle corresponding to substantially semi-circle in accordance with the rotation of the lower die 4. As a result, as shown in FIGS. 9*a* through 9*c*, the one end of the cut chip 25 is scraped from the recess 34 by the front end of the chip forming portion 43 of the scraper 40, and is coiled spirally due to the arc abutment surface of the chip forming portion 43. Note that the sliding cutter 32 is retracted inward from the bottom surface of the recess 34 by the cam profile of the cam 37 so as not to interfere with the scraper 40.

Figure 9D:
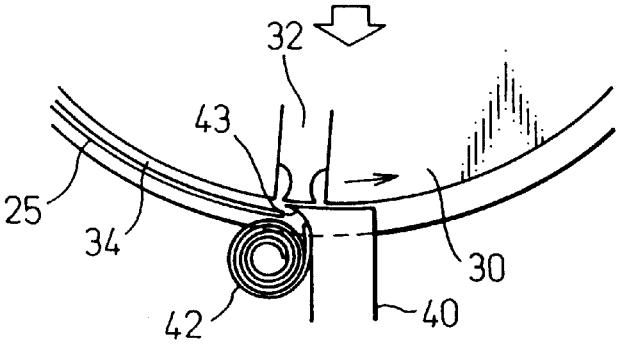

As may be seen in FIG. 9*d*, the spiral cut chip 42 in the form of a small coil having a diameter of, for example, approximately 5 mm, in accordance with the rotation of the lower die 4 is dropped onto and discharged through the chip discharge passage (not shown). Note that the sliding cutter 32 which has been moved on the inner side than the scraper 40 is projected again into the recess 34 due to the cam profile of the cam 37.

<Advantages of Embodiment>

As may be understood from the foregoing, in the elongated hole-piercing apparatus 1 according to the illustrated embodiment, it is possible to continuously feed the thin sheet whose length is very large in comparison with the thickness and width thereof in the direction of the length thereof, between the upper and lower roller dies 3 and 4 without stopping the movement of the thin sheet. Consequently, speeding-up of the elongated hole piercing operation for the thin sheet 2 can be achieved.

In an elongated hole piercing operation to form elongated holes 7 whose length is very large in comparison with the thickness and width of the thin sheet, the cut chips produced during the piercing operation can be discharged as small spiral cut chips 42, onto the chip discharge passage. Therefore, there is no fear that the chips are entangled or the chip discharge passage is obstructed by the cut chips. Moreover, since it is not necessary to stop the elongated hole-piercing apparatus 1 during the operation in order to remove the cut chips that are causes for the clogging of the discharge passage way, the cut chips separated from the thin sheet 2 can be immediately and efficiently discharged. This also contributes to speed-up of the elongated hole-piercing operation for the thin sheet 2.

In the elongated hole-piercing apparatus 1 of the illustrated embodiment, the adjustment of the feed speed of the thin sheet 2 corresponding to the increased speed feed of the automatic mounting operation makes it possible to obtain a pressing apparatus whose machining speed corresponds to the mounting speed. Consequently, the formation of the elongated holes in the thin sheet 2 and the mounting operation or the plastic working subsequent to the piercing operation can be carried out in a single continuous line.

As may be seen in FIG. 5, there are small gaps S between the front and rear portions 35*a* and 35*b* of the fitting portion 35 of the sliding cutter 32 and the front and rear end portions 21*a* and 21*b* of the recess 21 of the cutter roller 18, respectively to prevent a cutting edge interference. Due to the presence of the small gaps S when the fitting portion 35 of the sliding cutter 32 is engaged in the recess 21 of the cutter roller 18, the upper and lower roller dies 3 and 4 can be smoothly rotated.

The recess 21 of the cutter roller 18 is of a generally Ω-shape in which the opening end is narrower than the inner portion, as shown in FIGS. 4 through 6 and the front end of the fitting portion 35 of the sliding cutter 32 is shaped such that the width thereof increases toward the front end as shown in FIG. 7. Consequently, as shown in FIGS. 8*b* and 8*c*, when the fitting portion is engaged in the recess to separate the planar cut chip 25 from the thin sheet 2, the cutting gap defined between the front end 35*a* of the fitting portion 35 and the sharp edge 24 of the recess 21 is very small. Thus, the cut chips 25 can be finely cut from the thin sheet 2.

<Modified Embodiments>

Although the above mentioned embodiment has been directed to a thin sheet 2 whose length is very large in comparison with the thickness and width thereof as a workpiece, it is possible to use a metal sheet such as an aluminum alloy sheet whose length is greater than the thickness, as a workpiece. The workpiece is not limited to a flat plate and can be a slightly curved plate.

Although the above discussion has been addressed to the piercing operation to form elongated holes 7 whose length is much greater than the thickness of the thin sheet 2, it is possible to apply the present invention to the formation of elongated holes which are elongated in the width direction. For example, the present invention can be applied to form elongated holes in a substantially flat, U-shaped tank plate for a heat exchanger in which tubes are inserted in the elongated holes.

To modify the length of the elongated hole 7, the radii of the cutter rollers 18, 29 and 31 are appropriately increased or decreased, or the distance between the recesses 21 or between the sliding cutters 32 is appropriately increased or decreased. For instance, if the distance between the recesses 21 or the sliding cutters 32 is reduced from a 90° pitch to a 60° pitch, the length of the elongated hole to be formed in the workpiece is reduced. Conversely, if the distance between the recesses 21 or the sliding cutters 32 is increased from a 90° pitch to a 120° pitch, the length of the elongated hole to be formed in the workpiece is increased.

Furthermore, although the elongated holes 7 are formed in the thin sheet 2 at a predetermined pitch (equi-pitch) in the above mentioned embodiment, it is possible to form the elongated holes 7 at optional pitches in the workpiece.

Moreover, although a series of elongated holes 7 are formed along one line by a set of the cutter rollers 18, 29 and 31 and the sliding cutter 32 in the illustrated embodiment, it is possible to form two or more lines of a series of the elongated holes 7 using two or more sets of cutter rollers 18, 29 and 31 and the sliding cutter 32.

What is claimed is:

1. A piercing apparatus comprising (a) a first rotation roller which is provided with a convex first cutter which is adapted to form ends and sides of a hole to be formed in a workpiece, said first rotation roller being provided with at least one recess formed on a part of the outer periphery of the first cutter;

(b) a second rotation roller which is provided with a concave second cutter which is adapted to form sides of a hole to be formed in the workpiece when the workpiece passes between the first cutter and the second cutter, said second cutter being provided to engage with the first cutter to thereby form a hole in the workpiece passing between the first and second rotation rollers; and, (c) at least one cut chip discharge means provided on the second rotation roller so as to engage with said recess to thereby separate a cut chip from the workpiece when the cut chip discharge means is engaged in said recess.

2. A piercing apparatus according to claim 1, wherein the front and rear ends of the cut chip discharge means that is engaged in the recess in the direction of the movement of the second rotation roller are shaped so that there are predetermined gaps between the front and rear ends of the recess of the first cutter in the direction of the movement of the first rotation roller and said front and rear ends of said cut chip discharge means.

3. A piercing apparatus according to claim 2, wherein the front and rear ends of the cut chip discharge means that is engaged in the recess in the direction of the movement of the second rotation roller are shaped to prevent a cutting edge interference by said gaps, to permit the first and second rotation rollers to rotate while said cut chip discharge means is engaged in the recess.

4. A piercing apparatus according to claim 1, wherein the first cutter is provided on the outer periphery thereof with a plurality of the recesses which are spaced at a predetermined distance, and wherein the second rotation roller is provided with a plurality of cut chip discharge means corresponding to the recesses at the same distance as that of the recesses of said first cutter.

5. A piercing apparatus according to claim 4, wherein the workpiece is a thin sheet whose length is very large in comparison with the thickness or width thereof and can be continuously fed in the lengthwise direction thereof into an engagement portion between the first and second cutters, and wherein the hole to be formed is an elongated hole which is elongated in the lengthwise direction of the thin sheet and whose length is much larger than the thickness of the thin sheet.

6. A piercing apparatus according to claim 5, further comprising recesses provided in the second rotation roller, so that the cut chips separated from the workpiece by the cut chip discharge means can be held in said recesses; and a scraper provided with a chip forming portion which scrapes to remove said cut chips held in said recesses of said second rotation roller from said recesses and coils up said cut chips into a spiral form.

7. A piercing apparatus according to claim 6, wherein said chip forming portion has an arc abutment surface for coiling the cut chip into the spiral form.

8. A piercing apparatus according to claim 6, wherein cut chip discharge means is incorporated in the second rotation roller and is comprised of a sliding cutter which is retracted into or projected from the recess of the second rotation roller by a cam having a cam profile to prevent interference with the scraper.

9. A piercing apparatus according to claim 6, wherein said scraper is provided with a chip forming portion having an arc-shaped abutment surface which is in contact with an end face of the cut chip.

10. A piercing apparatus according to claim 9, wherein cut chip discharge means is incorporated in the second rotation roller and is comprised of a sliding cutter which is retracted into or projected from the recess of the second rotation roller by a cam having a cam profile to prevent interference with the scraper.

11. A piercing apparatus according to claim 4, further comprising recesses provided in the second rotation roller, so that the cut chips separated from the workpiece by the cut chip discharge means can be held in said recesses; and a scraper provided with a chip forming portion which scrapes to remove said cut chips held in said recesses of said second rotation roller from said recesses and coils up said cut chips into a spiral form.

12. A piercing apparatus according to claim 11, wherein said chip forming portion has an arc abutment surface for coiling the cut chip into the spiral form.

13. A piercing apparatus according to claim 11, wherein cut chip discharge means is incorporated in the second rotation roller and is comprised of a sliding cutter which is retracted into or projected from the recess of the second rotation roller by a cam having a cam profile to prevent interference with the scraper.

14. A piercing apparatus according to claim 11, wherein said scraper is provided with a chip forming portion having an arc-shaped abutment surface which is in contact with an end face of the cut chip.

15. A piercing apparatus according to claim 14, wherein cut chip discharge means is incorporated in the second rotation roller and is comprised of a sliding cutter which is retracted into or projected from the recess of the second rotation roller by a cam having a cam profile to prevent interference with the scraper.

16. A piercing apparatus according to claim 1, wherein the workpiece is a thin sheet whose length is very large in comparison with the thickness or width thereof and can be continuously fed in the lengthwise direction thereof into an engagement portion between the first and second cutters, and wherein the hole to be formed is an elongated hole which is elongated in the lengthwise direction of the thin sheet and whose length is much larger than the thickness of the thin sheet.

17. A piercing apparatus according to claim 16, further comprising recesses provided in the second rotation roller, so that the cut chips separated from the workpiece by the cut chip discharge means can be held in said recess; and a scraper provided with a chip forming portion which scrapes to remove said cut chip held in said recess of said second rotation roller from said recess and coils up said cut chip into a spiral form.

18. A piercing apparatus according to claim 17, wherein cut chip discharge means is incorporated in the second rotation roller and is comprised of a sliding cutter which is retracted into or projected from the recess of the second rotation roller by a cam having a cam profile to prevent interference with the scraper.

19. A piercing apparatus according to claim 17, wherein said chip forming portion has an arc abutment surface for coiling the cut chip into the spiral form.

20. A piercing apparatus according to claim 17, wherein said scraper is provided with a chip forming portion having an arc-shaped abutment surface which is in contact with an end face of the cut chip.

21. A piercing apparatus according to claim 20, wherein cut chip discharge means is incorporated in the second rotation roller and is comprised of a sliding cutter which is retracted into or projected from the recess of the second rotation roller by a cam having a cam profile to prevent interference with the scraper.

22. A piercing apparatus according to claim 1, further comprising at least one recess provided in the second rotation roller, so that the cut chip separated from the workpiece by the cut chip discharge means can be held in said recess; and a scraper provided with a chip forming portion which scrapes to remove said cut chip held in said recess of said second rotation roller from said recess and coils up said cut chip into a spiral form.

23. A piercing apparatus according to claim 22, wherein cut chip discharge means is incorporated in the second rotation roller and is comprised of a sliding cutter which is retracted into or projected from the recess of the second rotation roller by a cam having a cam profile to prevent interference with the scraper.

24. A piercing apparatus according to claim 22, wherein said chip forming portion has an arc abutment surface for coiling the cut chip into the spiral form.

25. A piercing apparatus according to claim 22, wherein said scraper is provided with a chip forming portion having an arc-shaped abutment surface which is in contact with an end face of the cut chip.

26. A piercing apparatus according to claim 25, wherein cut chip discharge means is incorporated in the second rotation roller and is comprised of a sliding cutter which is retracted into or projected from the recess of the second rotation roller by a cam having a cam profile to prevent interference with the scraper.

* * * * *